US006253601B1

(12) United States Patent
Wang et al.

(10) Patent No.: US 6,253,601 B1
(45) Date of Patent: Jul. 3, 2001

(54) SYSTEM AND METHOD FOR DETERMINING OIL CHANGE INTERVAL

(75) Inventors: Jerry C. Wang, Bloomington; Shawn Douglas Whitacre, Columbus; Matthew L. Schneider; Dean Harlan Dringenburg, both of Seymour, all of IN (US)

(73) Assignee: Cummins Engine Company, Inc., Columbus, IN (US)

( * ) Notice: Subject to any disclaimer, the term of this patent is extended or adjusted under 35 U.S.C. 154(b) by 0 days.

(21) Appl. No.: 09/221,625

(22) Filed: Dec. 28, 1998

(51) Int. Cl.[7] ..... G01M 15/00
(52) U.S. Cl. ..... 73/117.3; 340/438; 701/30
(58) Field of Search ..... 73/116, 117.2, 73/117.3, 118.1; 340/438, 439; 701/29, 30, 31, 35

(56) References Cited

U.S. PATENT DOCUMENTS

| | | | | |
|---|---|---|---|---|
| 4,345,202 | * | 8/1982 | Nagy et al. | 324/58.5 B |
| 4,495,417 | * | 1/1985 | Hohensang | 250/343 |
| 4,506,337 | * | 3/1985 | Yasuhara | 364/550 |
| 4,533,900 | * | 8/1985 | Muhlberger et al. | 73/117.3 |
| 4,694,793 | | 9/1987 | Kawakita et al. . | |
| 4,742,476 | | 5/1988 | Schwartz et al. . | |
| 4,796,204 | | 1/1989 | Inoue . | |
| 4,845,623 | | 7/1989 | Korb . | |
| 4,862,393 | | 8/1989 | Reid et al. . | |
| 4,970,492 | | 11/1990 | King . | |
| 5,043,697 | | 8/1991 | Ayabe et al. . | |
| 5,060,156 | * | 10/1991 | Vajgart et al. | 364/424.03 |
| 5,337,531 | | 8/1994 | Thompson et al. . | |
| 5,377,531 | | 1/1995 | Gomm . | |
| 5,382,942 | | 1/1995 | Raffa et al. . | |
| 5,633,796 | | 5/1997 | Cullen et al. . | |
| 5,750,887 | * | 5/1998 | Schricker | 73/117.3 |
| 5,789,665 | * | 8/1998 | Voelker et al. | 73/53.05 |
| 5,914,890 | * | 6/1999 | Sarangapani et al. | 73/117.3 |
| 5,969,601 | * | 10/1999 | Sato et al. | 340/450.3 |
| 5,987,976 | * | 11/1999 | Sarangapani | 73/117.2 |
| 6,037,864 | * | 3/2000 | Sem et al. | 340/457.4 |

* cited by examiner

*Primary Examiner*—George Dombroske
(74) *Attorney, Agent, or Firm*—Leydig, Voit & Mayer, Ltd.

(57) ABSTRACT

A system and method for indicating when the oil of an engine needs to be changed. The system includes measuring engine parameters such as engine temperature, fueling rate, engine speed, and engine load. At timed intervals, soot generation, viscosity increase, and total base number (TBN) depletion are estimated through a calculation for that time interval. The estimated values from the calculations are accumulated in separate loops. Once the accumulation of soot generation, oil viscosity increase, or TBN depletion reaches a predetermined magnitude for that respective oil property, then an indication or signal is provided to indicate to the engine operator that the oil needs changing. The system is supplemented with real time sensors such as an oil level sensor, a soot sensor, and a viscosity sensor which provide a back up for the calculation of estimates and also prevent catastrophic engine conditions from not being detected through electronic calculation of estimates. The system and method also can correct for the accumulation of oil consumption caused by evaporation of oil or leakage of oil. The algorithms used in the calculations can account for oil quality and fuel sulfur as well as the configuration of the engine, to allow the engine to be used in different geographic locations.

44 Claims, 6 Drawing Sheets

SYSTEM AND METHOD FOR DETERMINING OIL CHANGE INTERVAL

FIELD OF THE INVENTION

The present invention generally relates to oil lubricating systems of internal combustion engines and more particularly to systems for determining the oil change interval of engines.

BACKGROUND OF THE INVENTION

In internal combustion engines, lubricating oil degrades and becomes contaminated during engine use, necessitating procedures for changing that the oil. Such oil changes account for a significant amount of "down time" over the life of an engine. It is desirable to minimize the amount of service required for internal combustion engines to thereby minimize the interruption in use of the vehicle/equipment.

It is further desirable to minimize oil changes in order to reduce the amount of used lubricating oil that is removed from engines. Waste oil must be disposed of and/or processed in order to help prevent potential environmental hazards. Such oil disposal or processing resulting in undesirable costs. Therefore, extending oil drain intervals and reducing waste disposal are of great value to vehicle/equipment operators.

Oil drain intervals for engines are conventionally set assuming the most severe operating conditions and the lowest quality of oils known to the equipment producer. As a result, the drain interval is usually highly conservative, and much shorter than necessary. Most used oil is still quite functional. In general, a practice of prematurely replacing engine oil results in: the introduction of more waste oil into the environment; increased oil consumption and import demands; and higher overall engine maintenance costs. All of these matters can be improved if the engine oil in individual vehicles is optimally utilized before being replaced.

A modern trend is toward a tiered oil drain recommendation, whereby oil change intervals are recommended based upon various levels of severity of operation. However, it is impossible for engine/equipment/vehicle manufacturers to anticipate all user operations and list different oil drain intervals for each of them. Particularly most equipment/vehicles are used in more than one kind of operation. Additionally, a complex list of oil change guidelines can be confusing to a customer.

Another known approach is to determine oil drain interval based on used oil analysis to determine whether the oil still favorably meets certain criteria. Such an analysis is performed upon a small oil sample that is manually removed from an engine crankcase. Oil replacement is postponed if the used oil analysis yields positive results. This practice has various drawbacks. Firstly, significant costs are incurred in collecting and analyzing oil samples. Secondly, used oil samples themselves become hazardous waste along with many chemicals and solvents needed to do the analysis. Thirdly, sample mix-up and labeling errors are possible, leading to erroneous conclusions. Furthermore, used oil analyses typically results in an estimated change interval based upon previous engine operation, failing to account for possible future changes in operating conditions.

Some oil change indicator systems on engines are known. However, previous engine oil indicator systems have suffered from accuracy and reliability problems in addition to other problems and therefore have not been widely implemented on engines. One attempt of an oil change indicator system is set forth in Schricker, U.S. Pat. No. 5,750,887. Schricker asserts to provide a method for determining a remaining life of oil that includes the steps of measuring a plurality of engine parameters, determining an estimate of the characteristics or properties of the engine oil as a function of the engine parameters, and trending the estimate to determine the remaining life of the engine oil. The estimated properties for engine oil include a soot estimate, a viscosity estimate, oxidation estimate, and a total base number estimate, but it is not clear how all these estimates are obtained. The method asserted by Schricker also suffers from several drawbacks. In particular, a large memory capacity would appear necessary to keep all the data necessary for trending the data and a higher computational power would appear necessary to carry out statistical trending. These have cost and practicality disadvantages. Schricker also suffers from reliability problems. For example, if an operator suddenly changes from a long period of mild engine operation suddenly to a severe engine operation, delays in the oil change warning will result because the severe operation is smoothed out by the long period of mild conditions in the past.

SUMMARY OF THE INVENTION

It is therefore a general object of the present invention to provide a more reliable and practicable system and method for calculating and indicating when the oil of an engine needs to be changed. A more specific object according to a preferred embodiment of the invention is to provide an improved oil change indicator system for diesel engines.

The present invention is directed toward a method and system for determining the remaining life of the engine oil in an engine. Oil has multiple oil properties that degrade during use of the engine. Such oil properties may include concentration of soot contamination in the oil, depletion of total base number (TBN), and viscosity increase. Oil life is determined by the degradation of one or more oil property. The method includes measuring a plurality of engine parameters. Such engine parameters may include engine temperature, fueling rate, engine speed, and/or engine load. At periodic time intervals, an estimated degradation of at least one engine oil property is calculated based on the plurality of engine parameters for that time interval. The estimated degradation value of each property for that time interval is accumulated. When the accumulation of one of the values reaches a predetermined magnitude, an indication to the engine operator is provided.

It is an aspect of the present invention to provide at least one real time sensor on the engine in communication with the engine oil. Such real time sensors may include an oil level sensor, a viscosity sensor and a soot sensor. The soot sensor and viscosity sensor provide a back up for the estimated calculated accumulations of estimated soot and estimated viscosity. The oil level sensor can sense a catastrophic condition such as an oil level increase caused by a coolant leak or fuel leak into the oil or an oil leak which causes the oil level to drop. A display indicator is signaled if the soot or viscosity sensor senses that the oil needs to be changed or if the oil level sensor senses a catastrophic condition. The soot and viscosity sensors may also overwrite accumulation values of the respective estimated property values if the actual values are greater than estimated accumulations to thereby provide a more reliable system.

It is another aspect of the present invention that the method and system correct for oil consumption that may be caused by evaporation of oil and/or leakage of oil. Such oil consumption may include oil leakage and oil evaporation. This also provides a more reliable system.

These and other aims, objectives, and features of the invention will become more apparent from the following detailed description when taken in conjunction with the accompanying drawings.

Figure 1:
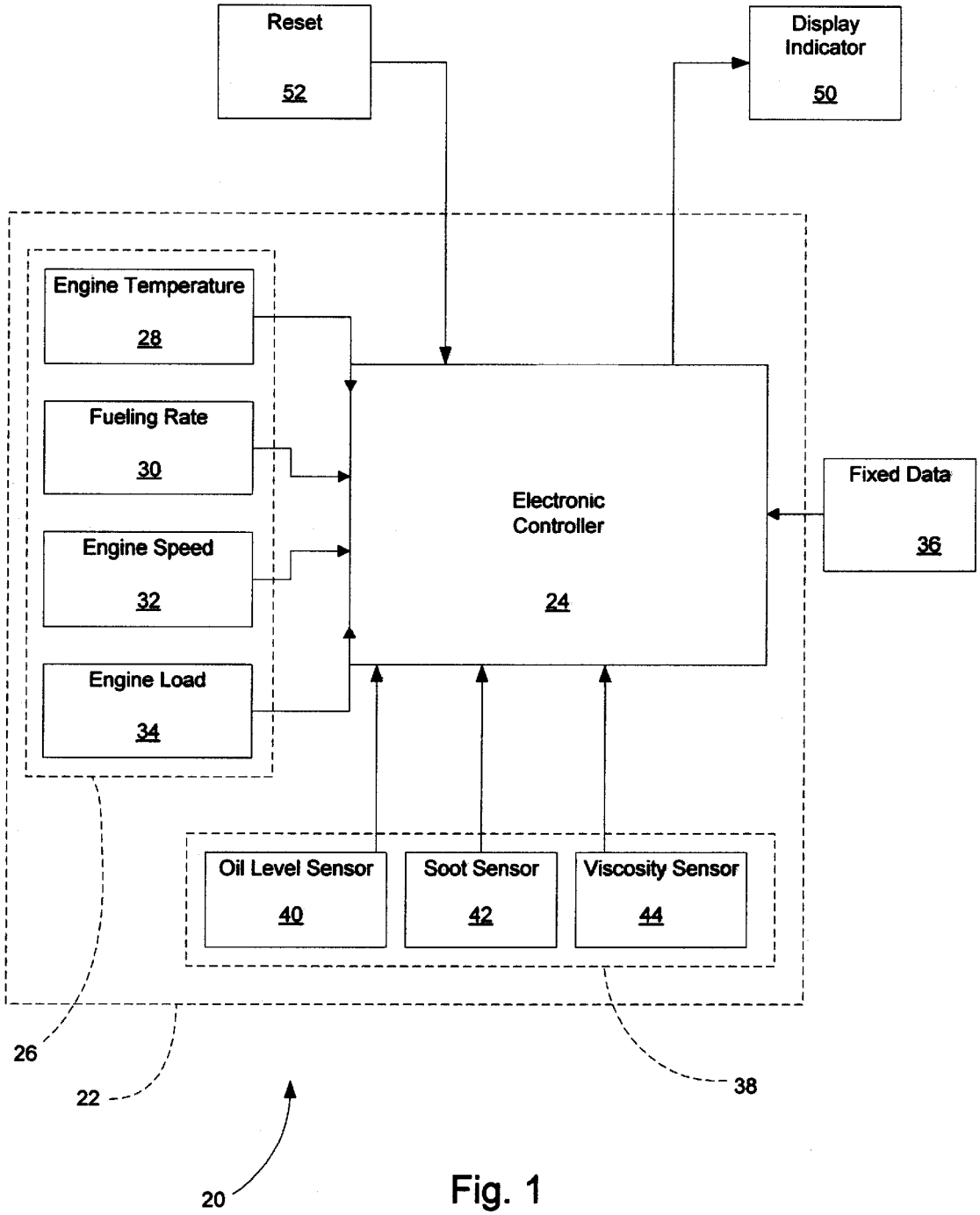
FIG. 1 is a schematic block diagram illustrating a preferred embodiment of the present invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

Referring to FIG. 1, an oil indicator system 20 for a diesel engine 22 is schematically illustrated in accordance with a preferred embodiment of the present invention. The system 20 includes a microprocessor or electronic controller 24 for processing sensor input data and generating an output. The electronic controller of the oil indicator system 20 may be integrally combined or closely associated with the Electronic Control Module (ECM) that is conventionally provided on most modern diesel engines, or may alternatively be a separate component from the ECM.

The electronic controller 24 includes an input in electrical communication with a plurality of engine sensors 26 for sensing or determining a plurality of engine operating parameters. Such engine parameters may include engine temperature 28, fueling rate 30, engine speed 32, and engine load 34. The engine sensors 26 are arranged on the engine 22 in a conventional manner. The engine temperature is preferably determined by an engine oil temperature sensor but may alternatively be derived from a coolant temperature sensor or other appropriate means. It will be appreciated to those skilled in the art these engine sensors 26 are commonly preexisting or already provided on conventional newly built diesel engines in communication with the engine ECM.

The electronic controller 24 also has a fixed data input 36 for receiving fixed data that may include fuel sulfur, oil quality, and engine configuration herein referred to as controlled parts list or CPL. The fuel sulfur and oil quality may differ in different geographical locations such as between different countries. The fixed data input 36 allows the system 20 to be pre-configured for a specific geographic location and reconfigured if necessary.

Preferably the oil indicator system 20 is supplemented with at least one and preferably multiple real time oil sensors 38 in electrical communication with the electronic controller 24. The oil sensors 38 are arranged on the engine 22 in communication with the engine oil for direct real time readings of oil conditions. The oil sensors 38 may include a oil level sensor 40, a soot sensor 42, and a viscosity sensor 44. A suitable oil level sensor 40 for use in the preferred embodiment may be a multilevel sensor, which is commercially available from Teleflex Electrical™, or a single level sensor which is commercially available from Robertshaw™. A suitable soot sensor 42 and suitable viscosity sensor 44 are commercially available from Computational Systems.

The electronic controller 24 provides an output connected to a display indicator 50, which may be a LED signal device, a digital counter meter or other appropriate display means that is preferably in view of the engine operator, such as in the cab of a vehicle for example. A manually operated reset 52 is arranged in a convenient location on the engine 22 or in the vehicle (not shown). The reset 52 is connected to the electronic controller 24 as an input thereto.

The electronic controller 24 utilizes the data from the engine sensors 26 and the fixed data input 36 to periodically calculate at least one and preferably a plurality of estimated degradations of at least one engine oil property. In the preferred embodiment, the electronic controller 24 calculates multiple oil properties including estimated quantity or concentration increase of soot generated during the time period, estimated increase in viscosity for the time period, and estimated depletion of total base number (TBN) for the time period. These oil properties of soot concentration, viscosity increase, and TBN depletion reliably determine the time interval for changing oil in diesel engines. Viscosity increase represents oil oxidation and for the purposes of the present invention includes the oil property of oil oxidation. TBN depletion is equivalent to acid build-up and for the purposes of the present invention includes acid build-up.

Before turning in greater detail to how estimates of oil degradation properties such as viscosity increase, TBN depletion, and soot generation for a time period are calculated, attention will first be given to the functional operation of the oil indicator system with reference to FIG. 2.

Once the engine is started 110 preset information 112 such as fuel sulfur percent and oil quality and variable information such as the remaining equivalent oil life (EOL) and remaining life of oil properties, which are stored 138 after the last engine shutdown. In the preferred embodiment, the stored equivalent oil life 112 accounts for three separate stored oil properties including soot contamination, viscosity, and TBN. If the oil has been just changed then predetermined values are inserted therefore. The system 20 then reads engine operating information 114 including engine temperature 28, fueling rate 30, engine speed 32 and engine load 34 all indicated at 116. These engine parameters 116 may be obtained either from the electronic control module (ECM) 118 or generated directly from the mechanical sensors 26. After engine operating information 114 is read, the system 20 calculates equivalent oil life (EOL) usage 120.

Figure 2:
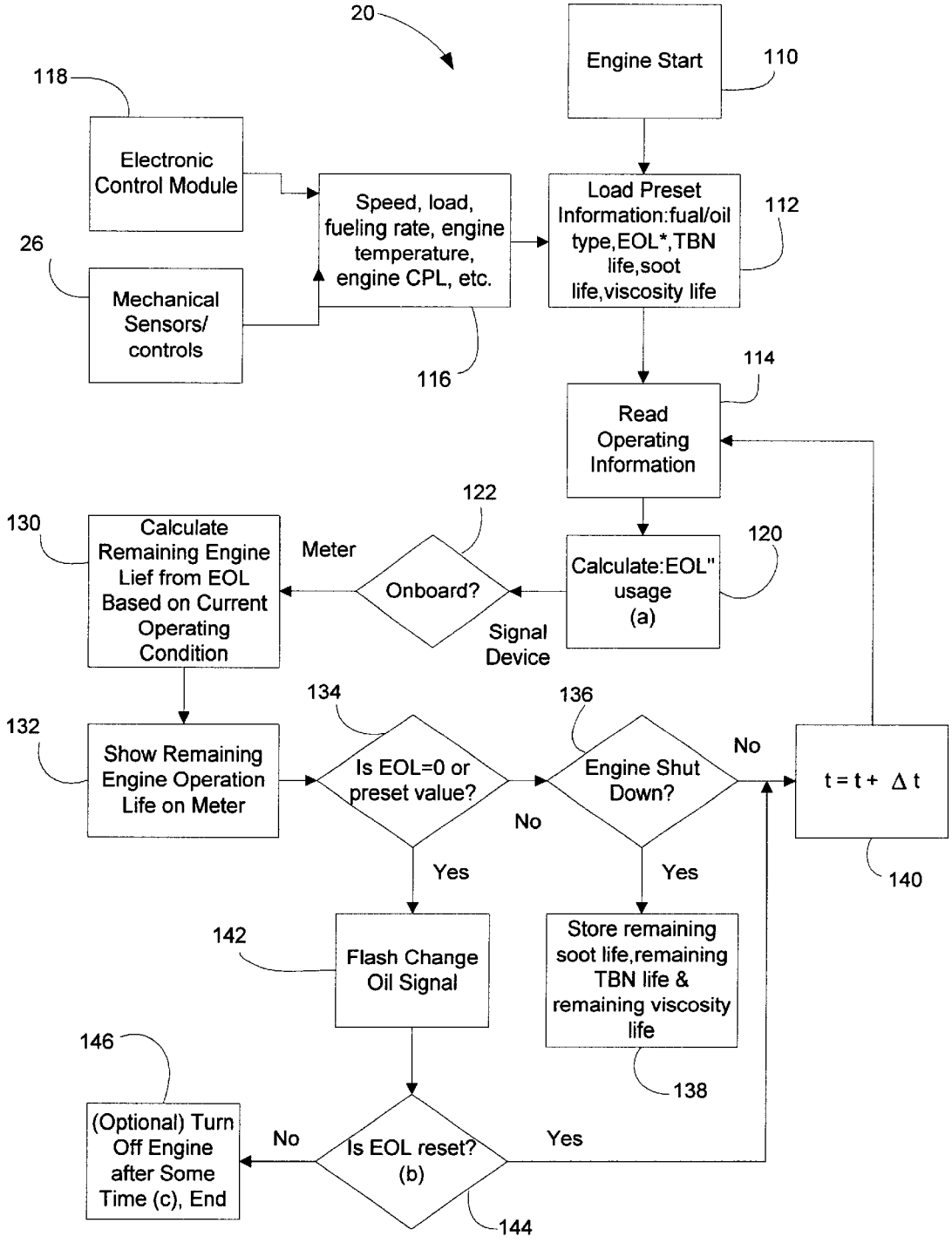
FIGS. 2–5 are functional flow diagrams illustrating the functional operation of a preferred embodiment of the present invention.
Figure 3:
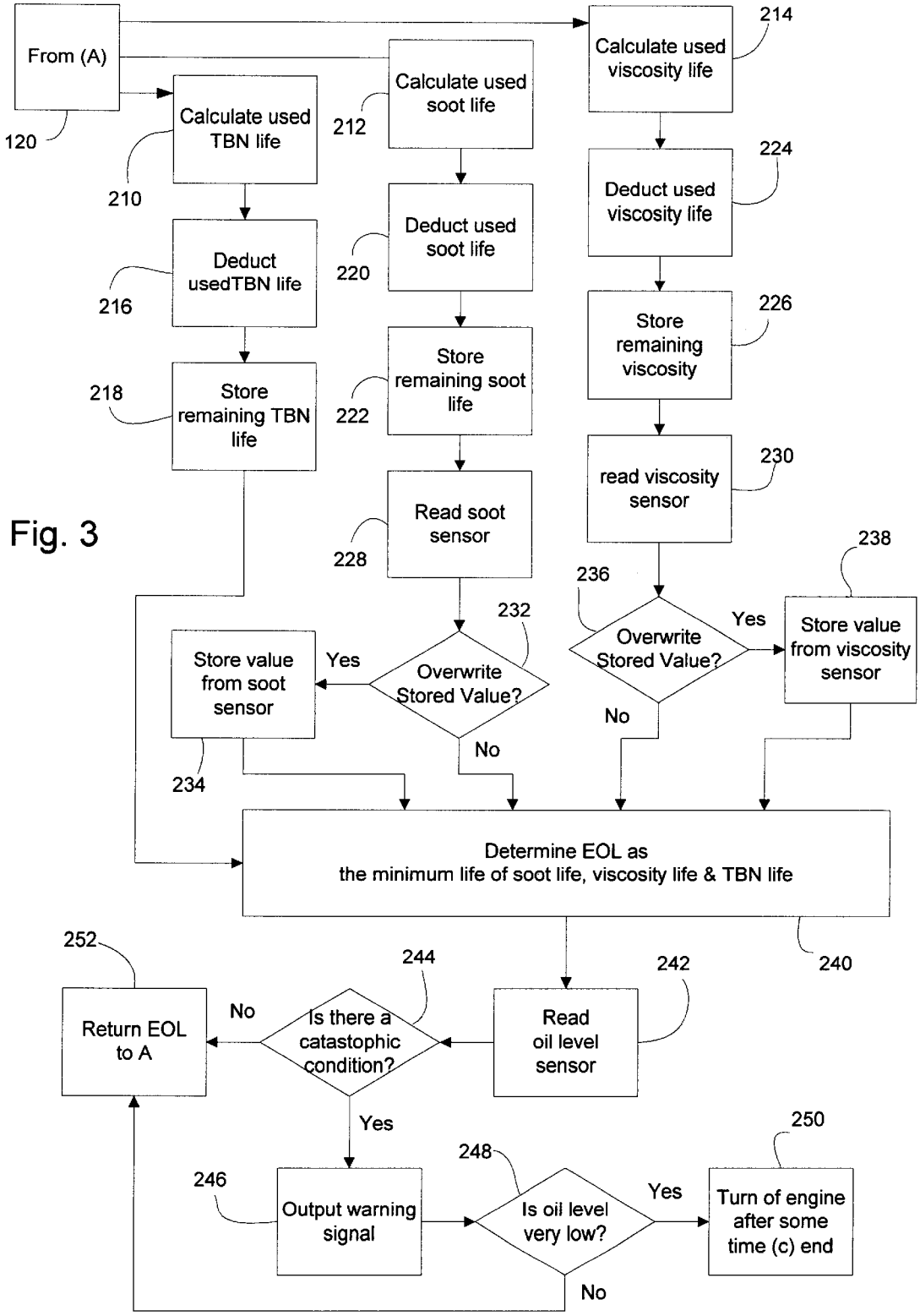

Referring to FIG. 3, used EOL 120 is determined by calculating the individual degradations of the oil properties, including estimated used TBN life 210, estimated used soot life 212, and estimated used viscosity life 214 based on the engine operating parameters 116 (FIG. 2). These life values represent soot quantity or concentration increase, viscosity increase, and TBN depletion, respectively. The calculation of these estimated values will be discussed later in further detail. The estimated degradations of oil properties are then accumulated, preferably in their own separate loop independent from the other oil properties. Accumulation is preferably accomplished in the electronic controller 24 but may also be accomplished integrally in the display indicator 50 if it includes a counter meter. The accumulation may be accomplished by subtracting the respective estimated used degradation of oil properties from the respective stored remaining life of the oil properties 112 (FIG. 2) or by adding/summating periodic life values. In the preferred embodiment, the system 20 deducts used TBN life from remaining TBN life 216 and stores a new or current remaining TBN life 218. Similarly, The system 20 deducts used soot life from remaining soot life 220 and stores a new or current remaining soot life 222. The system 20 also deducts used viscosity life from remaining viscosity life 224 and stores a new or current remaining viscosity life 226.

After the life values are stored, the soot and viscosity sensors 42, 44 (FIG. 1) are read 228, 230. The stored remaining soot life 222 and the reading of the soot sensor 228 are then compared 232. If the soot reading 228 is greater (represents a greater total soot concentration) than the stored remaining soot life 222, then the stored remaining soot life 222 is overwritten and the corresponding value from the soot sensor is stored 234. Similarly, the stored remaining viscosity life 226 and the reading of the viscosity sensor 230 are then compared 236. If the viscosity reading 230 is greater (represents a greater total viscosity increase) than the stored remaining viscosity life 226, then the stored remaining viscosity life 226 is overwritten and the corresponding value from the viscosity sensor is stored 238. It should be noted that due to current inaccuracies in viscosity and oil sensors that it may be desired to over write estimated or calculated accumulated values only if the actual sensed oil condition represents a valve much greater than the estimated or calculated accumulation rather than simply just greater. If either the soot sensor or the viscosity sensor sense no remaining oil life then the overwritten life values 234, 238 will ultimately result in a warning signal will be issued as will be described later. In an alternative embodiment, the viscosity and soot sensors may not overwrite the stored estimated values but instead separately signal the display indicator when the remaining life is used. It is an advantage that the real time oil sensors 38 (FIG. 1) provide a more reliable system.

The system 20 then determines remaining EOL 240 based on remaining TBN life 218, remaining soot life 222 (or 234 if overwritten), and remaining viscosity life 226 (or 236 is overwritten). In the preferred embodiment, the remaining EOL 120 is the minimum value of the three oil properties 218, 222, 226. In an alternative embodiment, the remaining EOL may be determined as a weighted or average function of the multiple oil properties. The system also reads the oil level sensor 242 to determine 244 if a catastrophic condition exists such as a sudden drop in oil level indicating an oil leak or simply a low oil level, or a sudden increase in oil level during engine operation which may indicate a fuel or coolant leak into oil. If so, then a warning signal is output 246 to the display indicator 50 (FIG. 1). If the oil level is very low 248, then the engine may optionally be shut off after some time 250. If the oil level is not very low or a catastrophic condition does not exist then the remaining EOL 240 is returned 252 to block 120.

Referring again to FIG. 1, the remaining EOL 122 may then be output to a display indicator which in the present embodiment includes both a signal device and a counter meter. For the meter, the system 20 estimates remaining engine operating life 130, such as remaining miles or other measure of engine operation. Preferably the system 20 estimates remaining engine operating life in miles by multiplying the remaining EOL by the miles traveled since the last oil change/or reset and dividing by the used EOL. Thus the remaining engine operating life is based on average operating conditions since the last reset. The remaining engine operation life 130 is then displayed on a meter 132. The system 20 then determines 134 whether the used oil life has reached a predetermined magnitude or there is no remaining engine oil life left.

If there is engine oil life left, the system senses whether the engine is shutting down 136. If so, then the remaining engine oil life, soot life, viscosity life, and TBN life are stored 138 until the next engine start 110. If not, then the system 20 waits a time period 140 before again reading operating information 114 and calculating remaining EOL or EOL usage 120 for the time period indicated in block 140.

However, if it has been determined that the remaining EOL has been depleted or the used EOL reached a predetermined magnitude, then the indicator flashes an change oil signal 142 to indicate that the operator needs to obtain an oil change. The oil change signal 142 stays activated until the reset 52 (FIG. 1) is reset 144 which resets the remaining EOL to an initialized predetermined value that is input into the preset information 112 . If the reset 52 is not activated after a given operation time interval, the engine may optionally be shut down 146. As indicated in FIG. 3, the reset may be a button on a dashboard, a sensor on the oil drain plug or filter, or the oil level sensor 40.

Figure 4:
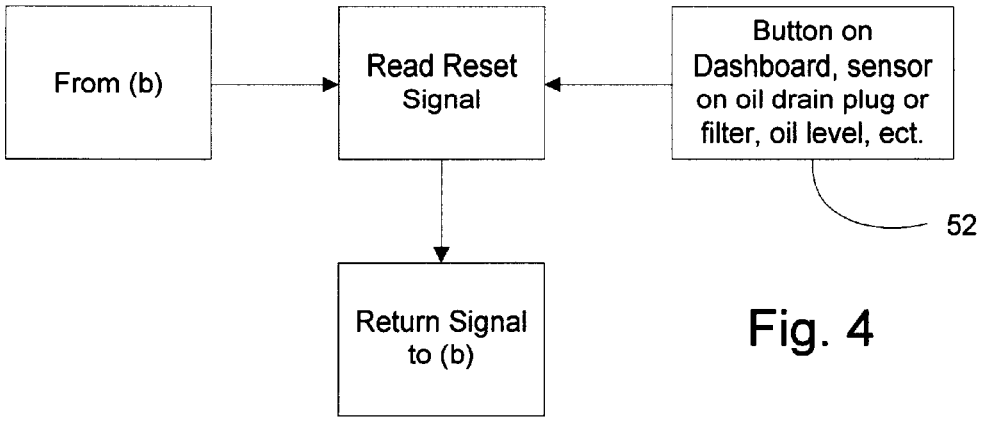
Figure 5:
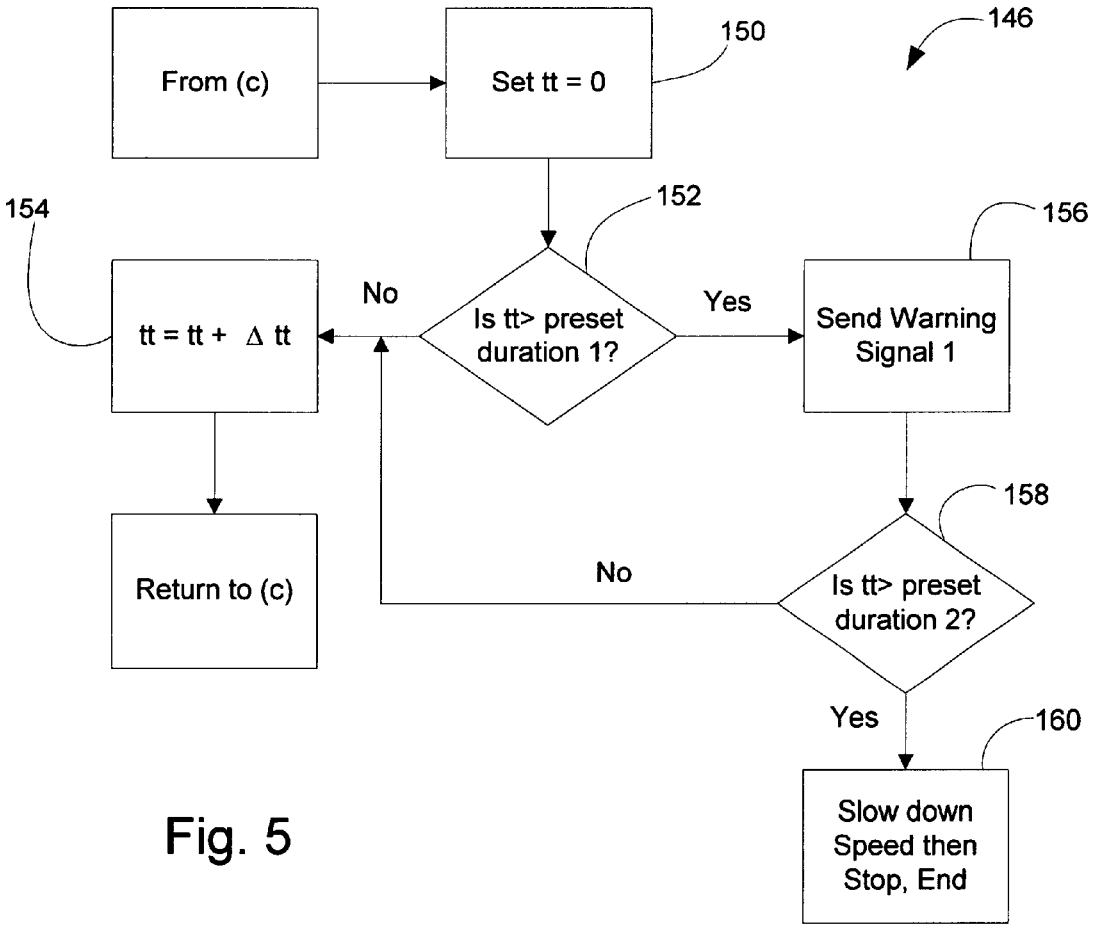

The optional engine shut down 146 can better be seen with reference to FIG. 4. Once there is no more remaining oil life, the shut down routine 146 starts to accumulate either miles, operating time, or other appropriate measure of engine operation for indicating when potential damage may result to the engine. The operating time is initialized 150 to provide a current operating time. The system 20 then determines whether the current operating time is greater than a preset magnitude 152. If the current operating time is not greater than preset duration, then a value for the time interval is periodically accumulated 154 for processing again through the loop. If the current operating time is greater than the preset duration then a first warning signal 156 is sent to the display indicator 50 (illustrated in FIG. 1). If the current operating time is greater than a second greater predetermined magnitude 158 then the engine may be slowed down and stopped 160. If not, then the system returns to continue accumulating operating time intervals.

In accordance with a preferred embodiment, there is provided preferred algorithms for use in calculating estimations of used TBN life 210, used soot life 212, and used viscosity life 214 for the time interval 140 based on the engine operating parameters 116. However, it will be appreciated that other algorithms may also be developed or used as appropriate in alternative embodiments.

In the preferred embodiment, the rate of TBN depletion is determined as a function of the fueling rate 30. The estimated rate of TBN depletion may be calculated by the following linear equation:

$$b=k_1+k_2F \qquad \text{Equation 1}$$

wherein:

b=TBN depletion rate for the time interval

F=The Fueling Rate $k_1$ and $k_2$=constants that adjust for fuel sulfur and oil quality level.

Figure 6:
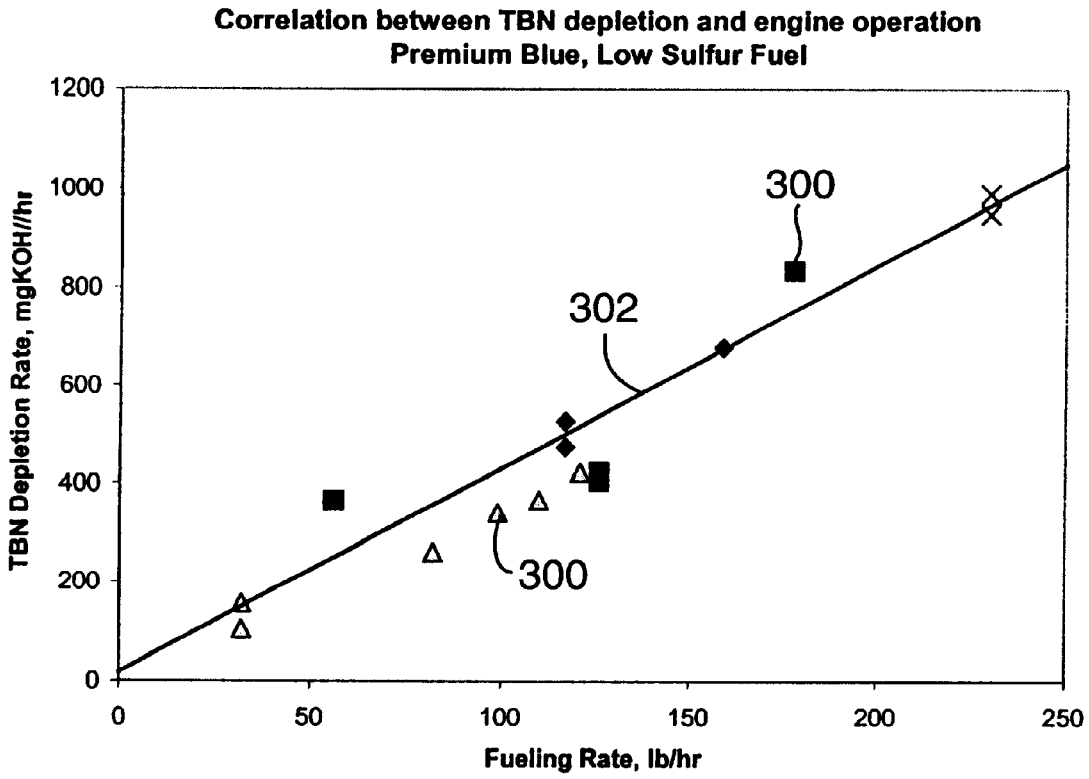
FIG. 6 is an exemplary graph correlating fueling rate to TBN depletion and illustrating an aspect of the preferred embodiment.

The constants, $k_1$, and $k_2$, are determined through statistical analysis of experimental testing of different fuels and oil qualities for different engines. An exemplary correlation established by Equation 1 through experimentation is represented by a graph in FIG. 6. In FIG. 6, experimental test data points 300 are used to derive the equation which in this case is linear represented by line 302. For accumulation, Equation 1 is periodically calculated and the TBN depletion rate product is multiplied by the time interval 140 to provide a used TBN value or life which is subtracted from the remaining TBN value or life. The remaining TBN can be represented by the following equation:

$$B=(B_o*P)-(b*t) \quad \text{Equation 2}$$

wherein:

B=TBN remaining in oil $B_o$=TBN concentration in new oil

P=Oil added at oil change interval (full capacity of oil sump)

b=TBN depletion rate (average over time)

t=time

To accumulate TBN, it is noteworthy that TBN depletion does not occur when "B" reaches zero. TBN depletion typically occurs when acids start to accumulate and bearings start to corrode, which normally occurs when 60–90% of the total available TBN is used depending upon oil quality, fuel sulfur and duty cycle. This can be accounted for in the preset TBN life.

In the preferred embodiment, viscosity increase is a function of engine temperature 28 and fueling rate 30. Rate of viscosity increase is similar to a chemical reaction rate function that can be expressed as:

$$\Theta=k_o e^{-E/RT} \quad \text{Equation 3}$$

wherein:

$K_o$, E and R=Fixed constants based on experimental data for the engine, oil quality, fuel sulfur Θ=Rate of increase in viscosity T=Engine Temperature The viscosity increase can be accumulated similar to TBN accumulation in Equation 2.

Figure 7:
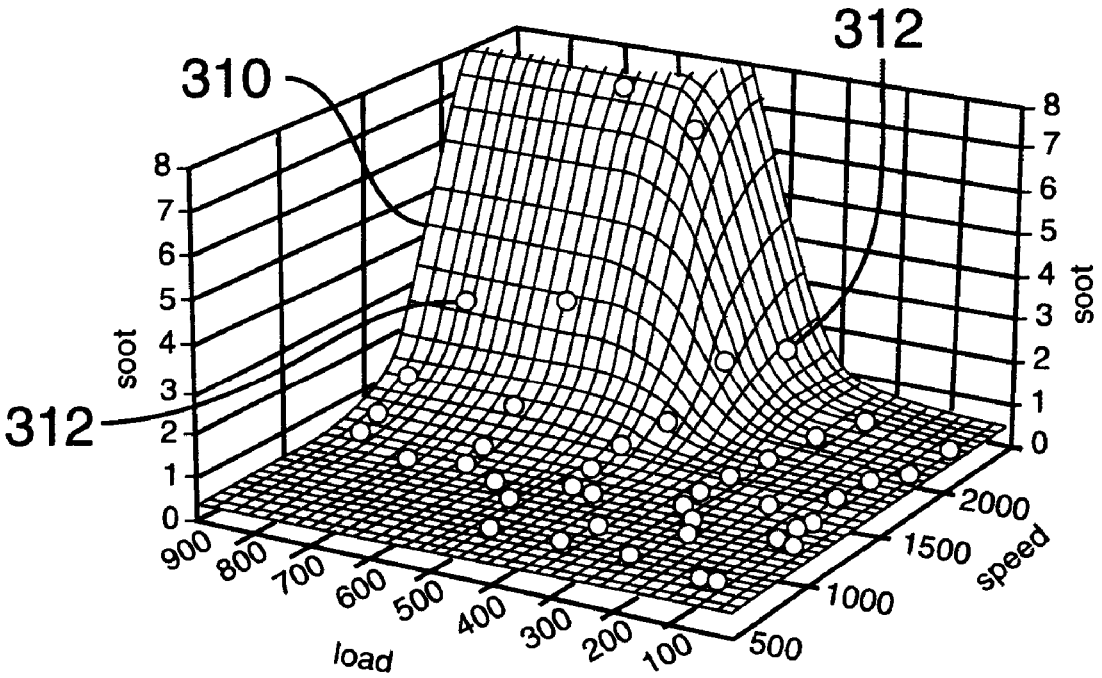
FIG. 7 is an exemplary soot map illustrating an aspect of the preferred embodiment.

Soot generation is dependent upon the configuration of the engine combustion system. Once the configuration of the engine combustion system becomes fixed, the rate of soot generation can be mapped and linked to operating conditions. In the preferred embodiment, soot generation is linked to engine speed 32 and load 34 as illustrated in the soot map 310 of FIG. 7, where circles 312 represent experimental test data used to generate the soot map 310. Different soot generation maps can be generated and tied to the CPL (Controlled Part List) which is used to identify key features of the configuration of the engine combustion system. By reading the CPL and the operating conditions, the electronic controller 24 can readily estimate soot rate production.

Preferably, the calculation of estimated oil degradations correct for oil consumption. Oil consumption includes evaporation of oil and oil leakage. Oil evaporation differs from oil leakage, however, in that soot and TBN remain in the oil with evaporation but are removed with oil leakage. Moreover, assuming periodic addition of oil to replace consumed oil, viscosity is decreased, soot concentration decreases and TBN is added during replacement of consumed oil at periodic oil fills. Because of these differences, it is desired to know the percentage of oil consumption from evaporation and leakage. Such percentage may be assumed as an estimate or obtained through experimental statistical analysis by measuring non-volatile substances in oil such as over-based detergents like Ca or Mg. A multilevel oil sensor may also sense added oil to correct the TBN, viscosity, and soot.

For TBN and soot, then the equations for correcting for oil consumption are:

$$C_{TBN}=[(p*B_o)+(a*B)]t \quad \text{Equation 4}$$

wherein:

p=Rate of overall oil consumption (or the oil added)

$B_o$=TBN concentration in new oil a=Rate of oil leakage

B=Amount of TBN concentration remaining in oil t=time interval of engine operation $$C_s=a*S*t \quad \text{Equation 5}$$

wherein:

a=Rate of oil leakage

S=Amount of Soot concentration remaining in oil t=time interval of engine operation The values $C_{TBN}$ and $C_s$ can then be added (or subtracted depending upon the method of accumulation)to the stored remaining TBN life, remaining soot life, and remaining viscosity life, respectively, to thereby correct for oil consumption which allows for a greater oil change interval. These above equations may be reconfigured and combined by conventional differential equation mathematics if so desired.

To correct for oil consumption for viscosity calculations, the equation for viscosity accumulation calculation can become:

$$S=\left(S_o-\frac{qS+\Theta}{q}\right)e^{-q*t/V}+\frac{qS+\Theta}{q} \quad \text{Equation 6}$$

wherein:

S=Viscosity of engine oil $S_o$=Viscosity of new oil

Θ=Rate of viscosity change from equation 3 q=Bulk amount of oil consumption (assuming oil added= oil consumed)

t=Drain interval or total accumulated operating time

V=Volume of engine oil sump

In order to incorporate fueling rate effect on viscosity, the drain interval "t" may be multiplied by the actual fuel rate during the time interval divided by the rated fueling rate.

What is claimed is:

1. A method for determining the remaining life of engine oil in an engine, the engine oil having an oil life being determined by degradation of at least one oil property, wherein the degradation of at least one oil property includes a viscosity increase, comprising:

measuring a plurality of engine parameters;

periodically calculating an estimated viscosity increase based on the plurality of engine parameters;

accumulating the estimated viscosity increase; and providing an indication when the accumulation of the estimated viscosity increase reaches a predetermined magnitude.

2. The method of claim 1 further comprising the steps of:

arranging at least one real time sensor on the engine in communication with the engine oil;

measuring an actual viscosity with the at least one real time viscosity sensor; and signaling a display indicator if the actual viscosity has exceeded the predetermined magnitude.

3. The method of claim 2 further comprising the step of overwriting the accumulation of the estimated viscosity increase with the real time viscosity sensor provides a corresponding value that is a preset magnitude greater than the accumulation of estimated viscosity increase.

4. The method of claim 1 further comprising the steps:

arranging an oil level sensor on the engine; and signaling a display indicator when a catastrophic condition is sensed by the oil level sensor to prevent catastrophic engine conditions from not being detected by the method.

5. The method of claim 1 wherein the step of accumulating includes providing a predetermined remaining permissible viscosity increase and periodically subtracting the estimated viscosity increase from the remaining permissible viscosity increase to compute a current remaining permissible viscosity increase.

6. The method of claim 1 further comprising the step of correcting the accumulation of estimated viscosity increase caused by consumption of oil.

7. The method of claim 1 wherein the step of providing an indication comprises displaying the accumulation on a counter device, a predetermined value on the counter device corresponding to the predetermined magnitude.

8. The method of claim 1 wherein the step of providing an indication comprises signaling a display indicator in response to the accumulation of the estimated viscosity increase reaching the predetermined magnitude.

9. The method of claim 1, wherein the degradation of at least one oil property further includes a total base number depletion, the method further comprising:

periodically calculating an estimated total base number depletion based on the plurality of engine parameters;

accumulating the estimated total base number depletion; and providing an indication when the accumulation of the estimated total base number depletion reaches a predetermined magnitude.

10. The method of claim 9, further comprising correcting the accumulation of estimated total base number depletion caused by the consumption of oil.

11. The method of claim 1, wherein the degradation of at least one oil property further includes soot concentration, the method further comprising:

periodically calculating an estimated soot concentration based on the plurality of engine parameters;

accumulating the estimated soot concentration; and providing an indication when the accumulation of the estimated soot concentration reaches a predetermined magnitude.

12. The method of claim 11, further comprising correcting the accumulation of estimated soot concentration caused by the consumption of oil.

13. A method for determining the remaining life of engine oil in an engine, comprising:

measuring a plurality of engine parameters including engine speed, fueling rate, engine load, and engine temperature using a plurality of engine sensors arranged on the engine;

periodically calculating an estimated value of soot generated for a time period between periodic calculations based on the measured engine parameters using an electronic controller;

accumulating the estimated values of soot;

periodically calculating an estimated depletion of total base number for a time period between periodic calculations based on the measured engine parameters;

accumulating the estimated depletions of total base number;

periodically calculating an increase in oil viscosity a time period between periodic calculations based on the measured engine parameters;

accumulating the estimated increases in oil viscosity;

correlating the accumulations of the estimated values of soot, of the estimated depletions of total base number, and of the estimated increases viscosity to an oil life value representing the remaining life of engine oil;

providing an indication when the oil life value reaches a predetermined magnitude.

14. The method of claim 13 further comprising the steps of:

arranging at least one real time sensor on the engine in communication with the engine oil;

measuring at least one real time condition with the at least one real time sensor, the at least one real time condition being selected from the group consisting of soot contamination and viscosity; and signaling an indicator if the actual oil condition has a predetermined magnitude.

15. The method of claim 14 further comprising the step of overwriting the accumulation of at least one selected from the group consisting of viscosity increase and soot generation, when the at least one real time sensor senses a corresponding value that is a preset magnitude greater than a current value of the accumulation.

16. The method of claim 13 further comprising the steps:

arranging an oil level sensor on the engine; and signaling a display indicator when a catastrophic condition is sensed by the oil level sensor to prevent catastrophic engine conditions from not being detected by said method.

17. The method of claim 13 wherein the step of providing an indication comprises displaying the value on a counter device, a predetermined value on the counter device corresponding to the predetermined magnitude.

18. The method of claim 13 wherein the step of providing an indication comprises signaling a display indicator in response to the value reaching the predetermined magnitude.

19. The method of claim 13 further comprising the steps of:

determining consumption of oil caused by evaporation of oil and leakage of oil; and correcting the accumulations of the estimated depletions of total base number, the estimated increases in oil viscosity, and the estimated quantities of soot based on the determined consumption of oil.

20. The method of claim 13 wherein the calculation of soot quantity is a function of engine speed and engine load, the calculation of total base number depletion is a function of fueling rate, and the calculation of viscosity increase is a function of engine temperature and fueling rate.

21. The method of claim 20 further comprising the step of using equations in said calculations, the equations including constants that account for an oil type, a fuel sulfur bevel, and a controlled parts lists, the constants being adjustable to allow the engine to be used in different geographic locations.

22. A oil indicator system for determining the remaining life of engine oil in an engine based upon at least one oil property including soot concentration, viscosity increase and total base number depletion, the system comprising:

a plurality of engine sensors arranged on the engine for sensing a plurality of engine parameters;

an electronic controller in electrical communication with the engine sensors, the electronic controller periodically calculating an estimated soot concentration, viscosity increase and total base number depletion of the oil, based on the sensed engine parameters;

means for respectively accumulating the estimated soot concentration, viscosity increase and total base number depletion; and means for indicating when the respective accumulation of any of the estimated soot concentration, viscosity increase or total base number depletion reaches a respective predetermined magnitude.

23. The oil indicator system of claim 22 further comprising a viscosity sensor arranged on the engine in communication with the engine oil, the viscosity sensor electrically communicating with the electronic controller, the at least one viscosity sensor measuring an actual viscosity of the oil, the indicating means being signaled if the actual viscosity reaches a predetermined magnitude.

24. The oil indicator system of claim 22 further comprising an oil level sensor arranged on the engine in communication with the engine oil, the oil level sensor in electrical communication with the electronic controller, the electronic controller signaling the indicating means when the oil level sensor senses a catastrophic oil condition, the indicating means providing an indication of the catastrophic oil condition.

25. The oil indicator system of claim 22 further comprising means for resetting the respective accumulation of each of the estimated soot concentration, viscosity increase and total base number depletion to a starting magnitude.

26. The oil indicator system of claim 22 wherein the accumulating means and indicating means are provided integrally in a counter device.

27. The oil indicator system of claim 22 wherein the accumulating means is part of the electronic controller.

28. The oil indicator system of claim 22 wherein the electronic controller has an input connectable to receive fixed data about controlled parts list, fuel sulfur and oil quality.

29. The oil indicator system of claim 22 further comprising a soot sensor arranged on the engine in communication with the engine oil, the soot sensor electrically communicating with the electronic controller, the soot sensor measuring an actual soot concentration of the oil, the indicating means being signaled if the actual viscosity reaches a predetermined magnitude.

30. A method for determining the remaining life of engine oil in an engine, the engine oil having an oil life being determined by degradation of at least one oil property, wherein the degradation of at least one oil property includes a total base number depletion, the method comprising:

measuring a plurality of engine parameters;

periodically calculating an estimated total base number depletion based on the plurality of engine parameters;

accumulating the estimated total base number depletion; and providing an indication when the accumulation of the estimated total base number depletion reaches a predetermined magnitude.

31. The method of claim 30 further comprising the steps:

arranging an oil level sensor on the engine; and signaling a display indicator when a catastrophic condition is sensed by the oil level sensor to prevent catastrophic engine conditions from not being detected by the method.

32. The method of claim 30 wherein the step of accumulating includes providing a predetermined remaining permissible total base number depletion and periodically subtracting the estimated total base number depletion from the remaining permissible total base number depletion to compute a current remaining permissible total base number depletion.

33. The method of claim 30 further comprising the step of correcting the accumulation of estimated total base number depletion caused by consumption of oil.

34. The method of claim 30, wherein the at least one oil property further includes viscosity increase, the method further comprising:

periodically calculating an estimated viscosity increase based on the plurality of engine parameters;

accumulating the estimated viscosity increase; and providing an indication when the accumulation of the estimated viscosity increase reaches a predetermined magnitude.

35. The method of claim 34 further comprising correcting the accumulation of estimated viscosity increase caused by consumption of oil.

36. The method of claim 34 further comprising the steps of:

arranging at least one real time viscosity sensor on the engine in communication with the engine oil;

measuring an actual viscosity increase with the at least one real time viscosity sensor; and signaling a display indicator if the actual viscosity increase has the predetermined magnitude.

37. The method of claim 36 further comprising the step of overwriting the accumulation of the estimated viscosity increase with the actual viscosity increase if the real time viscosity sensor provides a corresponding value that is a preset magnitude greater than the accumulation of estimated viscosity increase.

38. The method of claim 30, wherein the at least one oil property further includes soot contamination, the method further comprising:

periodically calculating an estimated soot concentration based on the plurality of engine parameters;

accumulating the estimated soot concentration; and providing an indication when the accumulation of the estimated soot concentration reaches a predetermined magnitude.

39. The method of claim 38 further comprising the steps of:

arranging at least one real time soot sensor on the engine in communication with the engine oil;

measuring an actual soot concentration with the at least one real time soot concentration sensor; and signaling a display indicator if the actual soot concentration has the predetermined magnitude.

40. The method of claim 39 further comprising the step of overwriting the accumulation of the estimated soot concentration with the actual soot concentration if the real time soot sensor provides a corresponding value that is a preset magnitude greater than the accumulation of estimated soot concentration.

41. The method of claim 34 further comprising correcting the accumulation of estimated soot concentration caused by consumption of oil.

42. An oil indicator system for determining the remaining life of engine oil in an engine according to at least one oil property, the at least one property including an increase of viscosity in the oil, the system comprising:

a plurality of engine sensors arranged on the engine for sensing a plurality of engine parameters;

an electronic controller in electrical communication with the engine sensors, the electronic controller periodically calculating an estimated viscosity increase based on the sensed engine parameters;

means for accumulating the estimated viscosity increase; and means for indicating when the accumulation of the estimated viscosity increase reaches a predetermined magnitude.

43. The oil indicator system according to claim 42, wherein at least one property further includes a total base number depletion, wherein the electronic controller periodically calculates an estimated total base number depletion based upon the sensed engine parameters; the system further comprising means for accumulating the estimated total base number depletion and means for indicating when the accumulation of the estimated total base number depletion reaches a predetermined magnitude.

44. An oil indicator system for determining the remaining life of engine oil in an engine according to at least one oil property, the at least one property including a total base number depletion, the system comprising:

a plurality of engine sensors arranged on the engine for sensing a plurality of engine parameters;

an electronic controller in electrical communication with the engine sensors, the electronic controller periodically calculating an estimated total base number depletion based on the sensed engine parameters;

means for accumulating the estimated total base number depletion; and means for indicating when the accumulation of the estimated total base number depletion reaches a predetermined magnitude.

* * * * *